United States Patent [19]

Ishii

[11] Patent Number: 4,829,638

[45] Date of Patent: May 16, 1989

[54] AUTOMATICALLY LOCKING SLIDER

[75] Inventor: Susumu Ishii, Kurobe, Japan

[73] Assignee: Yoshida Kogyo K. K., Tokjo, Japan

[21] Appl. No.: 134,750

[22] Filed: Dec. 18, 1987

[30] Foreign Application Priority Data

Dec. 19, 1986 [JP] Japan ..... 61-195521[U]

[51] Int. Cl.[4] ..... A44B 19/26

[52] U.S. Cl. ..... 24/421; 24/419; 24/429

[58] Field of Search ..... 24/418, 419, 420, 421, 24/429, 436

[56] References Cited

U.S. PATENT DOCUMENTS

| | | | |
|---|---|---|---|
| 2,634,485 | 4/1953 | Firing | 24/421 |
| 4,271,567 | 6/1981 | Aoki . | |
| 4,287,646 | 9/1981 | Kanzaka . | |
| 4,525,703 | 7/1985 | Ishii | 24/429 |
| 4,570,309 | 2/1986 | Ishii | 24/429 |
| 4,624,032 | 11/1986 | Ishii et al. | 24/419 |
| 4,667,376 | 5/1987 | Ishii et al. | 24/421 |

FOREIGN PATENT DOCUMENTS

| | | | |
|---|---|---|---|
| 493319 | 5/1980 | Belgium | 24/420 |
| 1049534 | 12/1953 | France | 24/421 |
| 2298974 | 8/1976 | France | 24/420 |
| 57-58966 | 12/1982 | Japan . | |
| 58-3527 | 1/1983 | Japan . | |
| 61-27449 | 8/1986 | Japan . | |

*Primary Examiner*—Kenneth J. Dorner
*Assistant Examiner*—Laurie K. Crammer
*Attorney, Agent, or Firm*—Hill, Van Santen, Steadman & Simpson

[57] ABSTRACT

In an automatically locking slider in which a pull tab is pivotally connected at its spindle portion to a housing having a built-in locking member and mounted on a upper wing of a slider body, a pull tab carrier is slidably mounted on the upper wing for movement between a closed position to prevent the spindle portion of the pull tab from being removed from the housing and an open position to release the spindle portion from the housing. The pull tab is normally urged to the closed position. Thus the pull tab is detachable for replacement with another.

5 Claims, 3 Drawing Sheets

AUTOMATICALLY LOCKING SLIDER

BACKGROUND OF THE INVENTION

1. Field of the Invention

This invention relates to an automatically locking slider for slide fasteners and to my copending application, U.S. Ser. No. 134,709, (filed on even date herewith).

2. Prior Art

A variety of slide fasteners are known which are equipped with means for automatically locking the slider members in position against accidental movement. Typical examples of such automatically locking slider are disclosed for example in Japanese Utility Model Publication Nos. 57-58966, 58-3527 and 61-27449. The prior art automatically locking sliders were however provided with pull tabs which had already been built in during assembling of the slider components. Such built-in pull tabs were therefore unable to be replaced once the sliders were finished as products.

SUMMARY OF THE INVENTION

It is therefore the primary object of the present invention to provide an automatically locking slider for a slide fastener which is constructed such that a pull tab can be mounted in operative position on the slider after the latter is assembled or can be removed for replacement with another at the option of the user.

According to this invention, in an automatically locking slider in which a pull tab is pivotally connected at its spindle portion to a housing having a built-in locking member and mounted on a upper wing of a slider body, a pull tab carrier is slidably mounted on the upper wing for movement between a closed position to prevent the spindle portion of the pull tab from being removed from the housing and an open position to the spindle portion from the housing. The pull tab is normally urged to the closed position. Thus the pull tab is detachable for replacement with another.

The above and other objects and features of the invention will become apparent to those versed in the art upon making reference to the following detailed description taken in connection with the accompanying drawings.

DETAILED DESCRIPTION OF THE INVENTION

Figure 1:
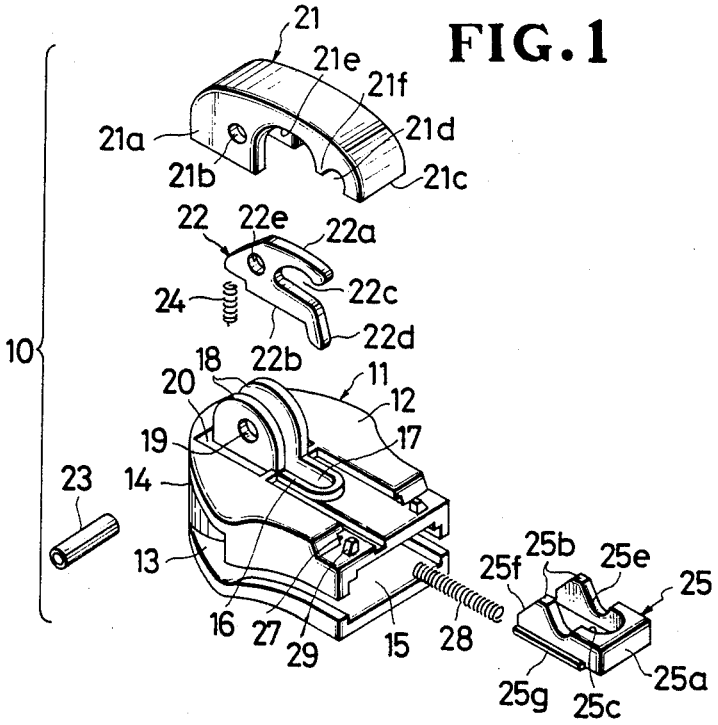
FIG. 1 is an exploded perspective view of a slider embodying the invention.

Referring now to the drawings and FIG. 1 in particular, there is shown an automatically locking type of slider 10 which comprises a slider body 11 including a flanged upper wing 12 and a flanged lower wing 13 joined at their one ends by a diamond 14 so as to define a Y-shaped guide channel 15 therebetween for the passage of a pair of coupling element rows of a slide fastener (not shown). The upper wing 12 has a U-shaped wall 16 defining an aperture 17 communicating with the guide channel 15 and adapted to receive a locking prong later described. The upper wing 12 further has a pair of laterally spaced support lugs 18 extending on opposite side of the aperture 17 and each having a pin hole 19.

A peripheral groove 20 is formed in the upper wing 12 around the pair of lugs 18 in the region of the diamond 14 and is adapted to fixedly receive a wide flange portion 21*a* of a cap or housing 21. The housing 21 has pin holes 21*b* registering with the pin holes 19 of the lugs 18. The housing 21 has its rear end (opposite to the diamond 14) cut away to provide a clearance or opening 21*c* for the passage of a pull tab 26 later described. A first small window 21*d* and a second large window 21*e* are formed transversely across the sidewalls of the housing 21 and are separated by a projection 21*f*.

A locking member 22 includes opposed arms 22*a* and 22*b* defining therebetween a bay 22*c* and a locking prong 22*d* extending downwardly from the arm 22*b* with a hole 22*e* at an opposite end to the prong 22*d*. The locking member 22 is interposed between the support lugs 18 and pivotally connected thereto by a pin 23 which extends through the holes 19, 21*b* and 22*e* thereby connecting the housing 21 and the locking member 22 integrally with the slider body 11.

Figure 2:
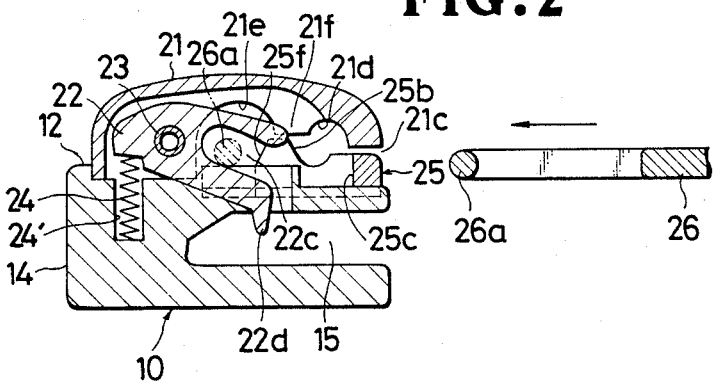
FIG. 2 is a longitudinal cross-sectional view of the same.
Figure 3:
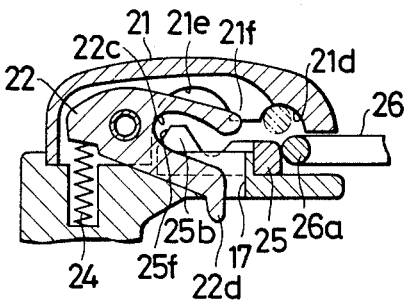
FIGS. 3 through 6 inclusive each are views similar to FIG. 2 but illustrating the sequence of attaching a pull tab to the slider of FIG. 1.
Figure 4:
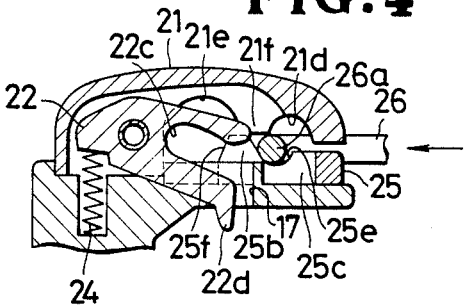

A spring 24 is accommodated in a cavity 24' formed in the diamond 14 and connected to the locking member 22 so as to normally urge the locking prong 22*d* into the guide channel 15 as shown in FIG. 2.

Designated at 25 is a pull tab carrier in the form of a rectangular block which has an abutment end wall 25*a* and a pair of spaced side posts 25*b* defining therebetween a cavity 25*c* which is substantially U-shaped as viewed in plan and which is dimensioned to fit around the peripheral wall 16 in the upper wing 12 of the slider body 11. Internally contiguous to each side post 25*b* is an arcuate recess 25*e* adapted to receive a spindle portion 26*a* of the pull tab 26, and externally contiguous to each side post 25*b* is a sloping end wall 25*f*. The pull tab carrier 25 is provided with a rail 25*g* secured to each of its side walls and slidably engageable in an elongated groove 27 formed in the upper wing 12 and extending longitudinally up to each of the support lugs 18. The carrier 25 is normally urged by a spring 28 to move outwardly but upon mounting the carrier 25 in place on the slider body 11 as shown in FIG. 2 it is blocked from such outward movement by a pair of stops 29 which are initially located outside of the grooves 27 but will, after the carrier 25 is assembled, be deformed to merge with and fill in the grooves 27.

Figure 5:
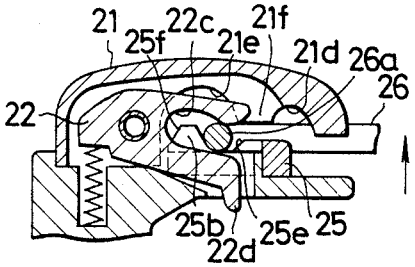
Figure 6:
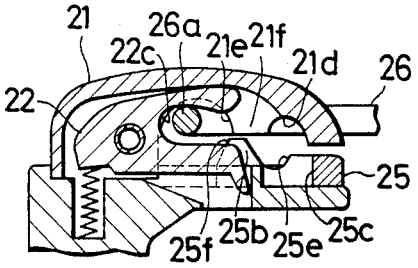

With the various slider parts of FIG. 1 assembled as shown in FIG. 2, the pull tab 26 will now be mounted in place in the sequence of steps illustrated in FIGS. 3–6 inclusive, in which the pull tab 26 is inserted through the opening 21*c* with its spindle 26*a* abutting against and causing the pull tab carrier 25 to move inwardly toward the diamond head 14 against tension of the spring 28 until the spindle 26*a* comes under and is received into the first window 21*d* of the housing 21. In this position of the spindle 26*a* indicated by phantom line in FIG. 3, the pull tab carrier 25 is released therefrom and returned to its initial position shown in FIG. 4 (FIG. 2) by the action of the spring 28, whereupon the spindle 26*a* is transferred to the arcuate recesses 25*e* in the carrier 25. As the pull tab 26 is further advanced, the carrier 25 is moved by the spindle 26*a* against the tension of the spring 28 again to the position of FIG. 3 wherein the spindle 26*a* enters into the bay 22*c* of the locking member 22 as shown in FIG. 5. The pull tab 26 is then lifted with its spindle 26*a* disengaged from the recesses 25*e* to allow the carrier 25 to return again to the original position as shown in FIG. 6 and at the same time urging the locking member 22 to rotate counterclockwise against the tension of the spring 24 until the locking prong 22*d* is fully retracted through the aperture 17 after being disengaged from fastener elements (not shown). Releasing the pull tab 26 now allows the locking member 22 to rotate clockwise by the return action of the spring 24 with the locking prong 22*d* back into engagement with the fastener elements thereby locking the slider 10 in position on the fastener as shown in FIG. 2. To release or unlock the slider 10 from the fastener, the pull tab 26 is pulled so that its spindle 26*a* slides up the sloping end wall 25*f*, lifting or rotating the locking member 22 counterclockwise away from the guide channel 15 to the position shown in FIG. 6.

Figure 7:
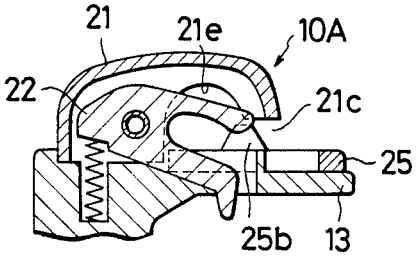
FIGS. 7 and 8 are modified forms of a slider embodying the invention.

FIG. 7 shows a modified slider 10A in which the housing 21 has only a single large window 21*e* contiguous to a rear end of the housing 21 so that both the large window 21*e* and the opening 21*c* are simultaneously closed and opened only by the pair of side posts 25*b* of the pull tab carrier 25. With this modified arrangement it is possible to reduce the entire length of the housing 21 to some extent, as compared with the previous embodiment of FIGS. 1 to 6.

Figure 8:
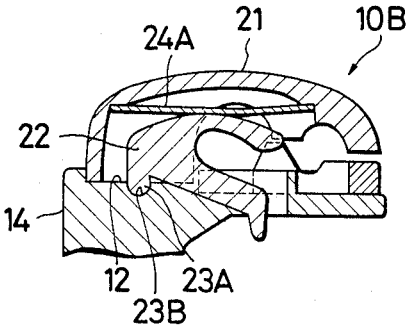

FIG. 8 shows another modified slider 10B in which the locking member 22 has at one end adjacent to the diamond 14 a pivot projection of semi-circular cross section rockably received in a recess 23B of generally semi-circular cross section formed in the top surface of the upper wing 12 and is pivotable about the pivot projection 23A. Thus the pivot projection 23A serves as the pin 23 of the previous embodiment. Further, in the modified slider 10B a leaf spring 24A is a substitute for the coil spring 24 of the previous embodiment. The leaf spring 24A is disposed between the housing 21 and the locking member 22 to normally urge the latter downwardly.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An automatically locking slider for a slide fastener having a pair of rows of coupling elements, comprising:

(a) a slider body including upper and lower wings joined at their front ends by a diamond so as to define a guide channel for the passage of the rows of coupling elements;

(b) a housing having in its opposite side walls a pair of transversely aligned large windows and secured to said upper wing;

(c) a locking member having a locking prong and pivotally accommodated in said housing, said prong being normally urged into the guide channel to lock the slider in position against displacement with respect to the rows of coupling elements, said locking member further having a bay substantially aligned with said large windows of said housing;

(d) a pull tab having a spindle portion to be pivotally received in said large windows and said bay; and (e) a pull tab carrier slidably mounted on said upper wing and movable between a closed position to prevent said spindle portion of said pull tab from being removed from said large windows, and an open position to allow said spindle portion of said pull tab to move into and out of said large windows, said pull tab carrier being normally urged to said closed position, said pull tab carrier has on its upper surface a pair of spaced side posts for closing said large windows when said pull tab carrier is in said closed position.

2. An automatically locking slider according to claim 1, wherein said pull tab carrier has a pair of transversely aligned arcuate recesses continuous to the respective side posts rearwardly thereof for temporarily receiving said spindle portion of said pull tab when said pull tab carrier carries said spindle portion of said pull tab into and out of said large windows.

3. An automatically locking slider according to claim 2, wherein said housing has in its opposite side walls a pair of transversely aligned small windows adjacent to a rear end of said housing for temporarily receiving said spindle portion of sail pull tab when said spindle portion is to be moved into and out of said arcuate recesses.

4. An automatically locking slider according to claim 3, wherein said small windows of said housing and said arcuate recesses of said pull tab carrier are locatable so as to face each other when said pull tab carrier is in said closed position.

5. An automatically locking slider according to claim 1, wherein said large windows are disposed adjacent to a rear end of said housing.

* * * * *